US010981711B2

(12) United States Patent
Smith

(10) Patent No.: US 10,981,711 B2
(45) Date of Patent: Apr. 20, 2021

(54) BAG-IN-BOX PACKAGING

(71) Applicant: WestRock Shared Services, LLC, Atlanta, GA (US)

(72) Inventor: Kenneth C. Smith, Marietta, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/347,404

(22) PCT Filed: Dec. 12, 2017

(86) PCT No.: PCT/US2017/065749
§ 371 (c)(1),
(2) Date: May 3, 2019

(87) PCT Pub. No.: WO2018/111836
PCT Pub. Date: Jun. 21, 2018

(65) Prior Publication Data

US 2019/0256271 A1 Aug. 22, 2019

Related U.S. Application Data

(60) Provisional application No. 62/434,725, filed on Dec. 15, 2016.

(51) Int. Cl.
*B65D 77/06* (2006.01)
*B67D 1/04* (2006.01)
(Continued)

(52) U.S. Cl.
CPC ..... *B65D 77/067* (2013.01); *B67D 1/00* (2013.01); *B67D 1/0462* (2013.01); *B67D 3/00* (2013.01);
(Continued)

(58) Field of Classification Search
CPC ..... B65D 77/067; B65D 1/00; B65D 1/0462; B65D 3/00
(Continued)

(56) References Cited

U.S. PATENT DOCUMENTS 5,803,346 A 9/1998 Baker et al.
7,275,679 B2 * 10/2007 Ingalls ..... B65D 5/4266 229/109
(Continued)

FOREIGN PATENT DOCUMENTS

GB 836246 A 6/1960
WO WO00/71428 A1 11/2000
WO 2010/043226 A1 4/2010

OTHER PUBLICATIONS

International Search Report dated Feb. 12, 2019, during the prosecution of corresponding PCT Application No. PCT/US2017/065749 (11 pages).
(Continued)

*Primary Examiner* — Vishal Pancholi
(74) *Attorney, Agent, or Firm* — John B. Swingle

(57) ABSTRACT

A bag-in-box packaging includes an outer box, a collapsible inner box disposed within an interior of the outer box, and a dispensing tap coupled to the inner bag. The outer box includes a side wall, a tap access feature formed in the side wall, and a removable top wall. The top wall includes overlapping first and second top flaps. The first top flap is hingedly connected to a front side of the side wall along a first tear line. The second top flap is hingedly connected to
(Continued)

a rear side of the side wall along a second tear line. The rear side of the side wall is disposed opposite the front side. The top wall is separable from the side wall along the first and second tear lines.

11 Claims, 8 Drawing Sheets

(51) Int. Cl.

| | |
|---|---|
| ***B67D 1/00*** | (2006.01) |
| ***B67D 3/00*** | (2006.01) |
| *B65D 5/02* | (2006.01) |
| *B67D 3/04* | (2006.01) |

(52) U.S. Cl.
CPC ..... *B65D 5/029* (2013.01); *B65D 5/0227* (2013.01); *B67D 3/04* (2013.01)

(58) Field of Classification Search
USPC ..... 222/105
See application file for complete search history.

(56) References Cited

U.S. PATENT DOCUMENTS

| | | | | |
|---|---|---|---|---|
| 7,681,783 | B2 * | 3/2010 | Stephenson | B65D 5/46008 220/495.01 |
| 2004/0089672 | A1 * | 5/2004 | Crosland | B65D 5/60 222/105 |
| 2007/0187471 | A1 * | 8/2007 | Ford | B65D 77/064 229/117.34 |
| 2009/0283579 | A1 * | 11/2009 | Kelly | B65D 5/4608 229/117.3 |
| 2010/0102112 | A1 * | 4/2010 | Ouillette | B67D 3/00 229/117.32 |
| 2010/0127057 | A1 * | 5/2010 | Burke | B65D 77/062 229/117.13 |
| 2011/0062223 | A1 | 3/2011 | Wall et al. | |
| 2011/0111938 | A1 | 5/2011 | Smith | |

OTHER PUBLICATIONS

Supplemental European Search Report issued in corresponding European Patent Application No. EP 17881270, dated May 19, 2020.

* cited by examiner

BAG-IN-BOX PACKAGING

REFERENCE TO RELATED APPLICATION

This application claims the benefit of priority under 35 U.S.C. § 119(e) of U.S. provisional application Ser. No. 62/434,725 filed on Dec. 15, 2016, which is hereby incorporated by reference in its entirety.

BACKGROUND

The field of the invention relates generally to bag-in-box packaging, and more particularly to a bag-in-box packaging suitable for use with a pressure-assisted dispensing device.

Bag-in-box packaging has been used to allow a user to dispense a liquid, such as wine, from the bag-in-box packaging. Conventionally, a collapsible bag or pouch containing a fluid therewithin (such as, for example, wine) is provided. A dispensing tap is provided and sealed to the bag. The tap may comprise any number of different style taps are that are conventionally used in such an application. The filled bag is placed within an outer box that is typically formed from a corrugated material. The outer box includes a removable portion which corresponds to the location of the tap within the outer box.

To access the tap, the user punctures the box proximate the removable portion and reaches into the box for the tap. The tap is then directed out of the box and coupled to the box. The tap can then be actuated to dispense product. Conventionally, the tap is located near the bottom of the bag-in-box packaging such that gravity feeds the liquid from the pouch to the tap. This configuration typically requires the bag-in-box packaging to be placed at the edge of a table or other surface when dispensing liquid so as to allow a cup or other container to be positioned beneath the tap. This requirement may disadvantageously limit a user's options by requiring the user to position the bag-in-box packaging at an undesirable height or location.

Another of the problems associated with conventional bag-in-box packaging is that the bag collapses upon itself as the liquid is withdrawn, which tends to create pockets of liquid that are isolated from the tap and cannot be withdrawn from the bag.

Recently a pressure-assisted dispensing device has been proposed that is configured to apply constant, mild pressure to the pouch of a bag-in-box packaging so as facilitate complete dispensing of the pouch's contents. In addition, the use of applied pressure removes the need to rely on gravity for the dispensing action, permitting the bag-in-box packaging to be positioned in an "inverted" configuration with the tap at the top. The present invention is directed to a bag-in-box packaging that is suitable for use with such a device.

SUMMARY OF INVENTION

According to a first aspect of the invention there is provided a bag-in-box packaging including an outer box, a collapsible inner bag disposed within an interior of the outer box, and a dispensing tap coupled to the inner bag. The outer box includes a side wall, a tap access feature formed in the side wall, and a removable top wall. The top wall includes overlapping first and second top flaps, wherein the first top flap is hingedly connected to a front side of the side wall along a first tear line and the second top flap is hingedly connected to a rear side of the side wall along a second tear line. The rear side of the side wall is disposed opposite the front side. The top wall is separable from the side wall along the first and second tear lines.

Optionally, the side wall includes a front panel, a rear panel disposed opposite the front panel, and a side wall blank wrapped around the front and rear panels. The first top flap is hingedly connected to the front panel along the first tear line. The second top flap is hingedly connected to the rear panel along the second tear line.

Optionally, the front and rear panels are generally rectangular in shape.

Optionally, the outer box is generally cylindrical in shape.

Optionally, the side wall blank includes a tap access aperture disposed over the tap access feature.

Optionally, the side wall blank is formed from a single faced corrugated material.

Optionally, the second top flap includes a fold line extending between opposite side edges of the second top flap and dividing the top flap into an inner portion and an outer portion, wherein the outer portion is larger in area than the inner portion.

Optionally, the fold line includes one or more partial-depth cuts formed on an interior surface of the second top flap.

Optionally, an interior surface of the outer portion is adhesively connected to the first top flap, and the outer portion is not adhesively connected to the first top flap.

Optionally, the outer box includes a bottom wall. The bottom wall is formed form overlapping first and second bottom flaps. The first bottom flap is hingedly connected to the front side of the side wall, and the second bottom flap is hingedly connected to the rear side of the side wall.

Optionally, the tap access feature includes at least one removable tab.

Optionally, the bag-in-box packaging is configured for use with a pressure-assisted dispensing device.

According to a second aspect of the invention, a set of blanks is provided. The set of blanks is configured to form an outer box for use with bag-in-box packaging. The set of blanks include a side wall blank, a dispenser-side insert blank, and a rear-side insert blank. The dispenser-side insert blank includes a front panel that includes a tap access feature, a first top flap hingedly connected to a top end of the front panel along a first tear line, and a first bottom flap hingedly connected to a bottom end of the front panel. The rear-side insert blank includes a rear panel, a second top flap hingedly connected to a top end of the rear panel along a second tear line, and a second bottom flap hingedly connected to a bottom end of the rear panel. In a set-up outer box, the first and second top flaps overlap to form a top wall of the set-up outer box, the first and second bottom flaps overlap to form a bottom wall of the set-up outer box, the front and rear panels are disposed opposite one another, and the side wall blank wraps around the front and rear panels to form a side wall of the outer box. In the set-up outer box, the top wall is separable from the side wall along the first and second tear lines.

Optionally, the side wall blank is generally rectangular in shape.

Optionally, the front and rear panels are generally rectangular in shape.

Optionally, the set-up outer box is generally cylindrical in shape.

Optionally, the side wall blank includes a tap access aperture configured to be disposed over the tap access feature in the set-up outer box.

Optionally, the side wall blank is formed from a single faced corrugated material.

Optionally, the second top flap includes a fold line extending between opposite side edges of the second top flap and dividing the top flap into an inner portion and an outer portion, wherein the outer portion is larger in area than the inner portion.

Optionally, the fold line is formed from one or more partial-depth cuts formed on an interior surface of the second top flap.

Within the scope of this application it is envisaged that the various aspects, embodiments, examples, features and alternatives set out in the preceding paragraphs, in the claims and in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION

Detailed description of specific embodiments are disclosed herein. It will be understood that the disclosed embodiments are merely examples of the way in which certain aspects of the invention can be implemented, and do not represent an exhaustive list of all the ways the invention may be embodied. As used herein, the word "exemplary" is used expansively to refer to embodiments that serve as illustrations, specimens, models, or patterns. Indeed, it will be understood that the embodiments described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
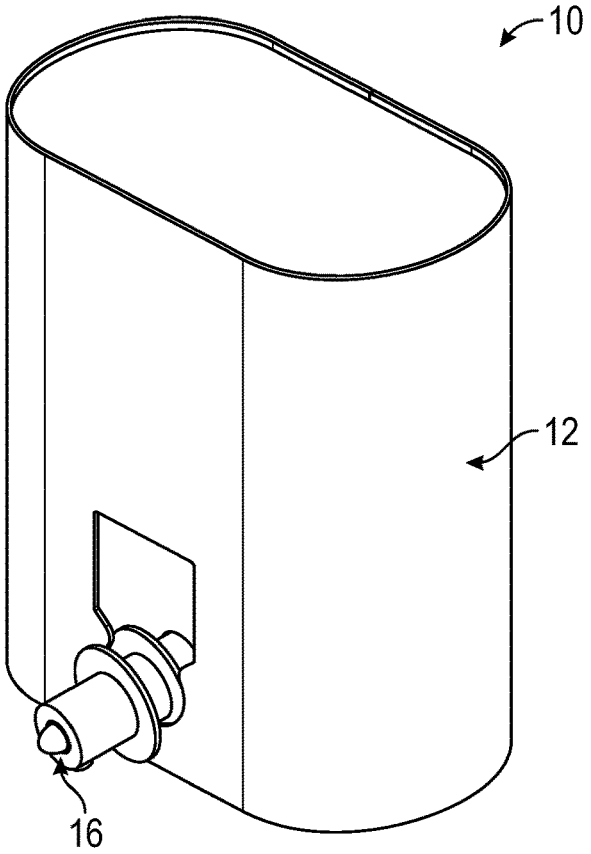
FIG. 1 is a perspective view of a bag-in-box packaging according to one embodiment of the invention, showing the bag-in-box packaging in a dispensing configuration with the tap coupled to the outer box.

Referring to FIG. 1, bag-in-box packaging of the present disclosure is shown generally at 10. The bag-in-box packaging of the present disclosure is typically well suited for use in association with any number of different industries and for carrying any number of different flowable materials. For example, the packaging is particularly well suited for use in association with the wine industry, for what is known as bag-in-box wine. The packaging is not limited for use in association with any particular type of industry or any particular flowable material.

Bag-in-box packaging 10 includes an outer box 12 enclosing an inner bag 14 (see FIG. 8) paired with a dispensing tap 16. As illustrated, the outer box 12 has a generally oblong cylindrical configuration. However other shapes may be used, including but not limited to circular cross-sectional shapes, polygon cross-sectional shapes, square cross-sectional shapes and rectangular cross-sectional shapes. The outer box 12 can be formed from three pieces of blank material that each preferably comprise a corrugated paperboard material: a side wall blank 18 (FIG. 2), a dispenser-side insert blank 20 (FIG. 3), and a rear-side insert blank 22 (FIG. 4). A decorative and/or informational outer layer of printed material may be presented on the outer surface of outer box 12.

Figure 5:
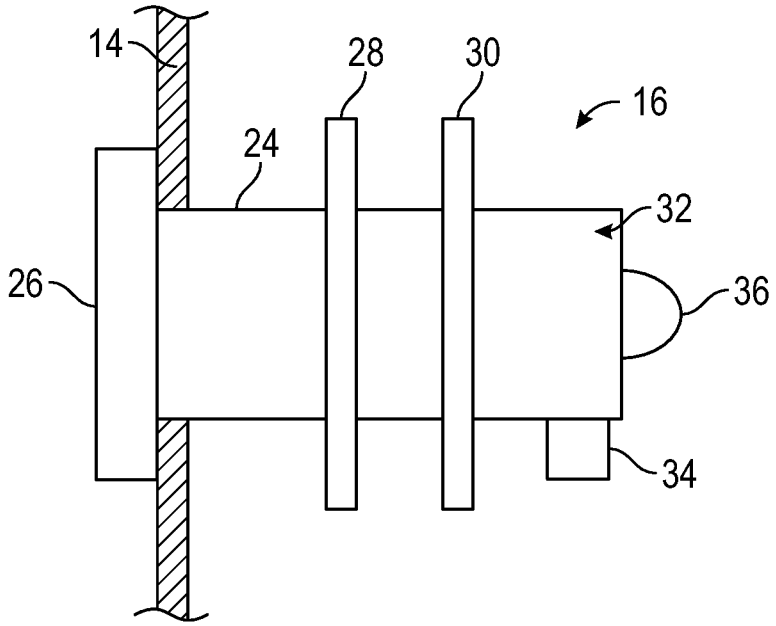
FIG. 5 is a side view of a tap that can be used to form part of the bag-in-box packaging of FIG. 1.

Inner bag 14 may comprise a conventional collapsible prepackaged and vacuum-sealed plastic bag containing a flowable material such as, for example, wine. Dispensing tap 16 is disposed at one side of a lower end of inner bag 14 for dispensing the bag's contents. Any number of different configurations are contemplated for the dispensing tap, and the disclosure is not limited to any particular dispensing tap configuration, or any particular dispensing tap. One embodiment of a dispensing tap 16 is shown in FIG. 5. As illustrated, dispensing tap 16 includes a neck portion 24 with a rear flange 26 which is sealed to the inner bag 14, an intermediate flange 28 spaced forwardly therefrom, and a radial front flange 30 spaced forwardly from the intermediate flange 28. The dispensing tap 16 includes a forward-most dispensing portion 32 that includes a dispensing opening 34. Dispensing portion 32 is preferably rotatable so as to enable a user to change the orientation of dispensing opening 34. Dispensing portion 32 also includes an actuator 36 that can be actuated to dispense the contents of inner bag 14 out through dispensing opening 34.

Figure 2:
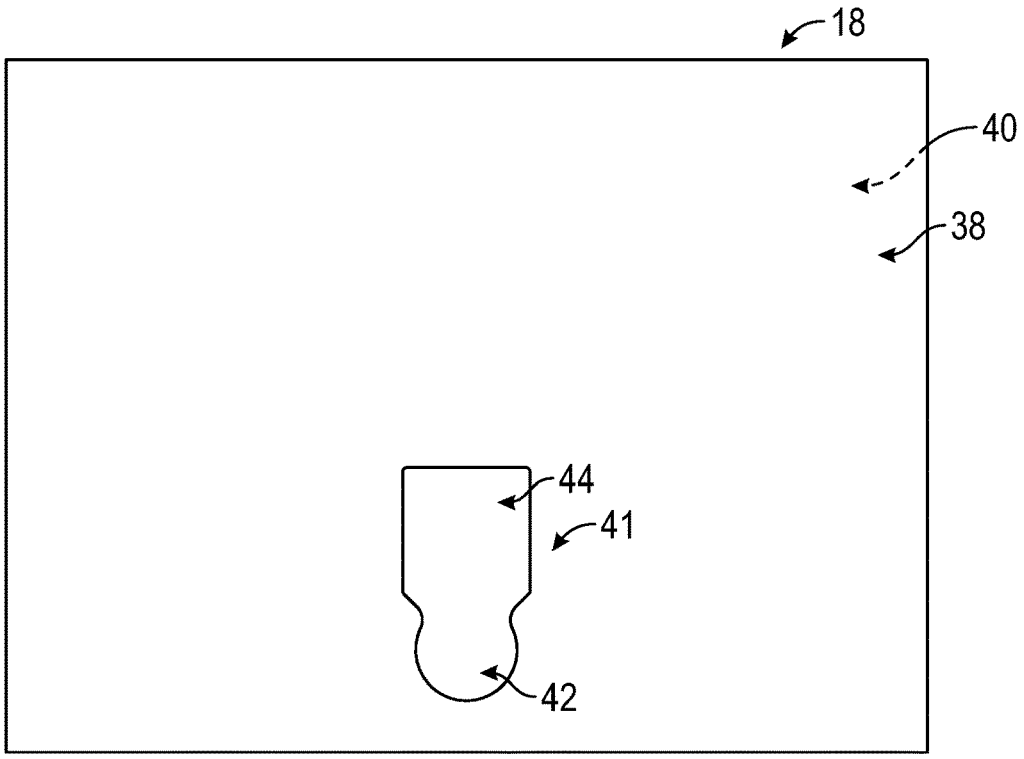
FIG. 2 is a top plan view of a side wall blank that can be used to form part of the bag-in-box packaging of FIG. 1.

Referring to FIG. 2, side wall blank 18 is generally rectangular in shape and preferably comprises a single faced corrugated board. Side wall blank 18 has a flat linerboard side 38 that forms an exterior surface of the outer box side wall and a fluted side 40 (see FIG. 6) that forms an interior surface of the outer box side wall. Side wall blank 18 includes a tap access aperture 41 that has a generally "keyhole"-shaped configuration in the illustrated embodiment. Aperture 41 includes a generally circular lower portion 42 adjacent to and abutting a generally rectangular upper portion 44.

Figure 3:
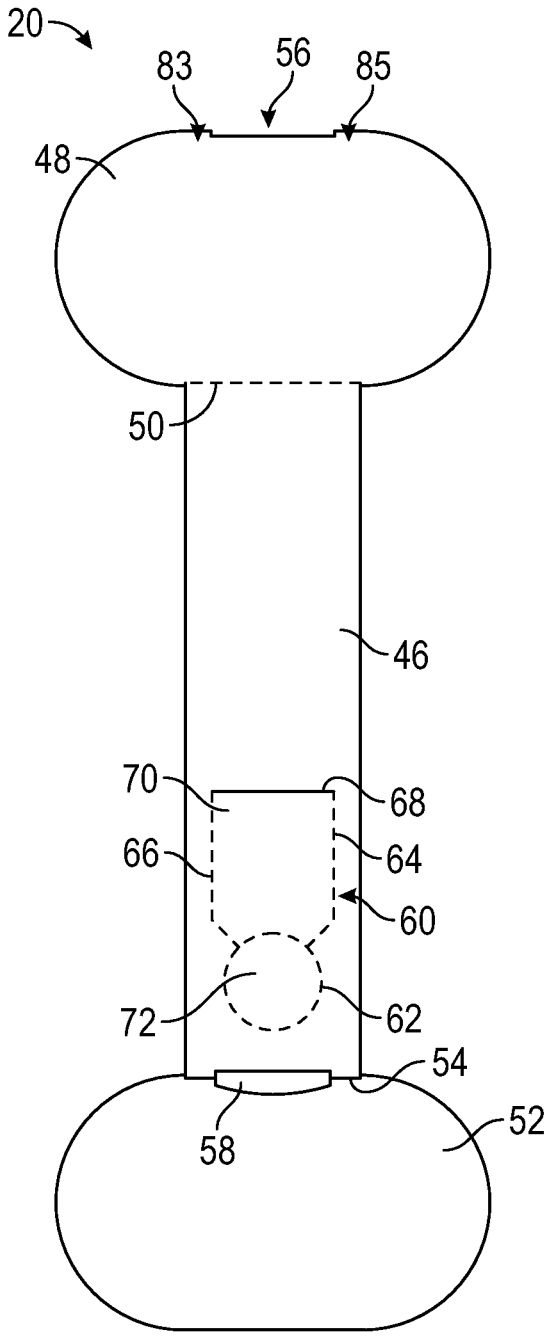
FIG. 3 is a top plan view of a dispenser-side insert blank that can be used to form part of the bag-in-box packaging of FIG. 1.
Figure 4:
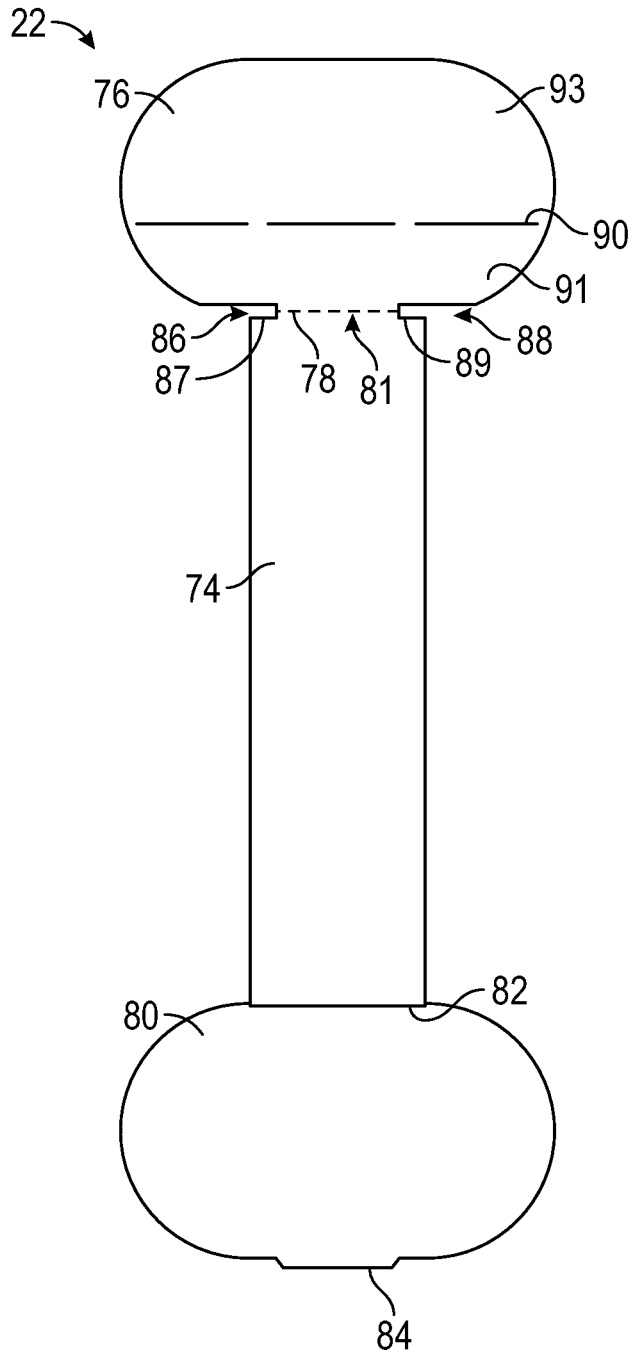
FIG. 4 is a top plan view of a rear-side insert blank that can be used to form part of the bag-in-box packaging of FIG. 1.

Referring to FIG. 3, dispenser-side insert blank 20 includes a generally rectangular front panel 46. Front panel 46 is hingedly connected along its upper edge to a first top flap 48 via tear line 50. Front panel 46 is hingedly connected along its lower edge to a first bottom flap 52 via fold line 54.

First top flap 48 and first bottom flap 52 generally mirror one another and have a generally elliptical or oblong shape in the illustrated embodiment. First top flap 48 and first bottom flap 52 each have a substantially oblong shape in the illustrated embodiment, although other shapes may be used. First top flap 48 includes a notch 56 struck from its outermost free edge. An elongated aperture 58 is disposed along a central length of, and interrupts, fold line 54. Thus, aperture 58 is struck in part from first bottom flap 52 and in part from front panel 46. A tap access feature 60 is disposed on a lower portion of front panel 52. Tap access feature 60 has a generally keyhole-shaped configuration that may be identical or substantially similar to the shape of tap access aperture 41. Tap access feature 60 comprises a removable lower tab 72 that is generally circular in shape and defined by tear line 62. Lower tab 72 is adjacent to and abuts upper tab 70. Upper tab 70 is generally rectangular in shape and is defined by side tear lines 64 and 66 and a generally horizontal fold line 68.

Referring to FIG. 4, rear-side insert blank 22 generally mirrors dispenser-side insert blank 20. Rear-side insert blank 22 includes a generally rectangular rear panel 74. Rear panel 74 is hingedly connected along its upper edge to a second top flap 76 via tear line 78. Rear panel 74 is hingedly connected along its lower edge to a second bottom flap 80 via fold line 82. Second top flap 76 and second bottom flap 80 generally mirror one another and have a generally elliptical or oblong shape in the illustrated embodiment. Second top flap 76 and second bottom flap 80 each have a substantially oblong shape in the illustrated embodiment, although other shapes may be used. Second bottom flap 80 includes a tab 84 that projects from its outermost free edge. Second top flap 76 includes generally rectangular-shaped notches 86 and 88 that are struck from opposite side edges of front panel 74 along tear line 78. Thus, notches 86, 88 also extend partially into second top flap 76. A fold line 96 extends across the length of second top flap 76 between opposite side edges. Fold line 90 is preferably formed from a series of partial-depth cuts made on the interior surface of second top flap 76. Fold line 90 divides second top flap 76 into a smaller inner portion 91 and a larger outer portion 93.

One method of constructing the bag-in-box packaging 10 as illustrated in FIG. 1 will now be described. The forming process is not limited to that described below and may be altered according to particular manufacturing requirements.

Figure 6:
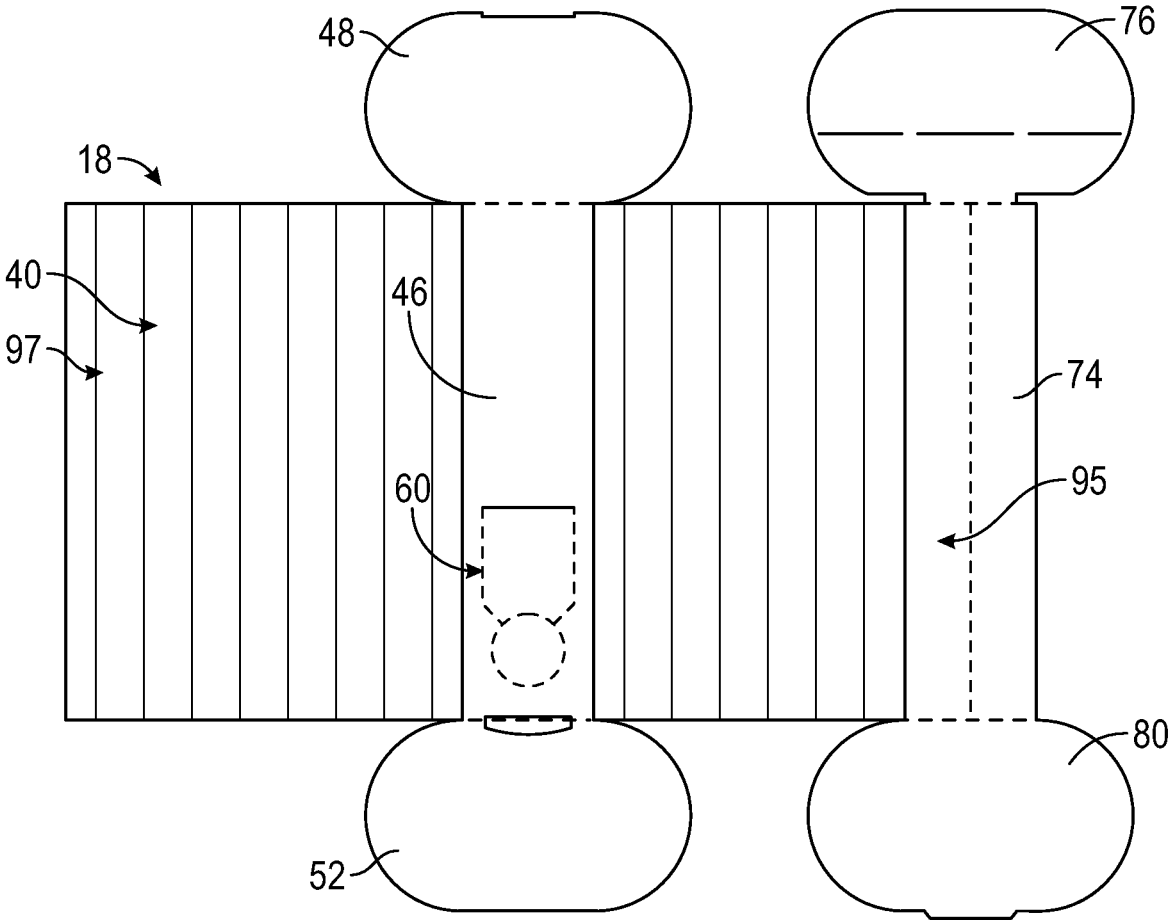
FIGS. 6-8 show various steps in the construction of the bag-in-box packaging of FIG. 1.

As shown in FIG. 6, side wall blank 18 can be positioned with its interior surface/fluted side 40 face up. Glue or other adhesive treatment can be applied to the exterior surface of front panel 46 or, alternatively, to a corresponding portion of the interior surface of side wall blank 18. The exterior surface of front panel 46 is then positioned over the interior surface of side wall blank 18 so as to align tap access aperture 41 with tap access feature 60. The exterior surface of front panel 48 is brought into face-contacting relationship with the interior surface of side wall blank 18 and secured thereto. Glue or other adhesive treatment can be applied to the exterior surface of rear panel 74 or, alternatively, to a corresponding portion of the interior surface of side wall blank 18. Rear panel 74 is positioned in partially-overlapping alignment with a first outermost side edge portion 95 of side wall blank 18. An overlapping portion of the exterior surface of rear panel 74 is brought into face-contacting relationship with the interior surface of side wall blank 18 and secured thereto. Side wall blank 18 is then wrapped around so as to bring second outermost side edge portion 97 into face-contacting relationship with the exposed portion of rear panel's 74 exterior surface, securing the two together and forming a generally tubular enclosure.

Figure 7:
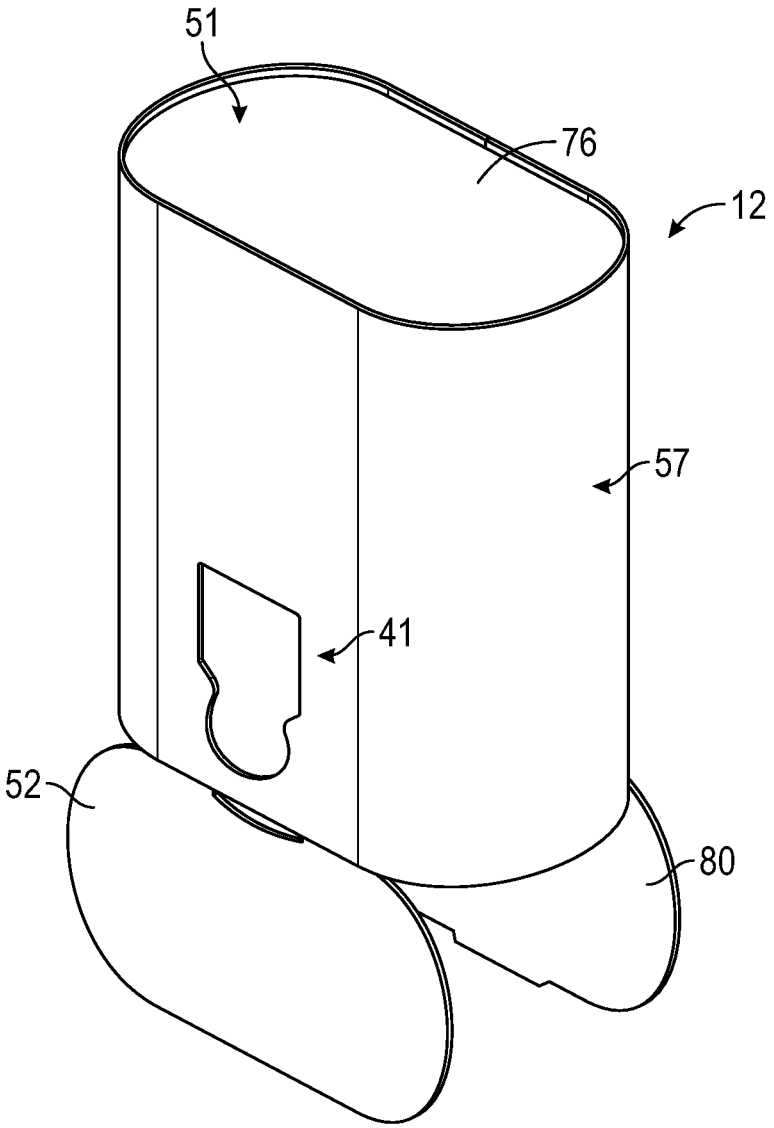

First top flap 48 is folded inwardly about tear line 50 until it is substantially perpendicular to front panel 46. This positions reduced thickness portion 81 of rear-side insert blank 22 (i.e., the portion defined between notches 86 and 88) within notch 56 of dispenser-side insert blank 20. Projecting portions 83 and 85 adjacent to and defined by notch 56 catch on shoulders 87 and 89 of rear-side insert blank 22, thereby arresting further downward folding of first top flap 48. Glue or other adhesive treatment is applied to outer portion 93 of the interior surface of second top flap 76 or, alternatively, to a corresponding portion of the outer surface of first top flap 48. Second top flap 76 is then folded inwardly about tear line 78, thereby bringing its inner surface into face-contacting relationship with the outer surface of first top flap 48 and securing it thereto. Preferably, inner portion 91 of second top flap 76 is not adhered to first top flap 48. This results in the formation of the partially-constructed outer box 12 as shown in FIG. 7. First and second top flaps 48, 76 together form composite top wall 51 of outer box 12. Side wall blank 18 together with front and rear panels 46, 74 form a side wall 53 of outer box 12.

Figure 8:
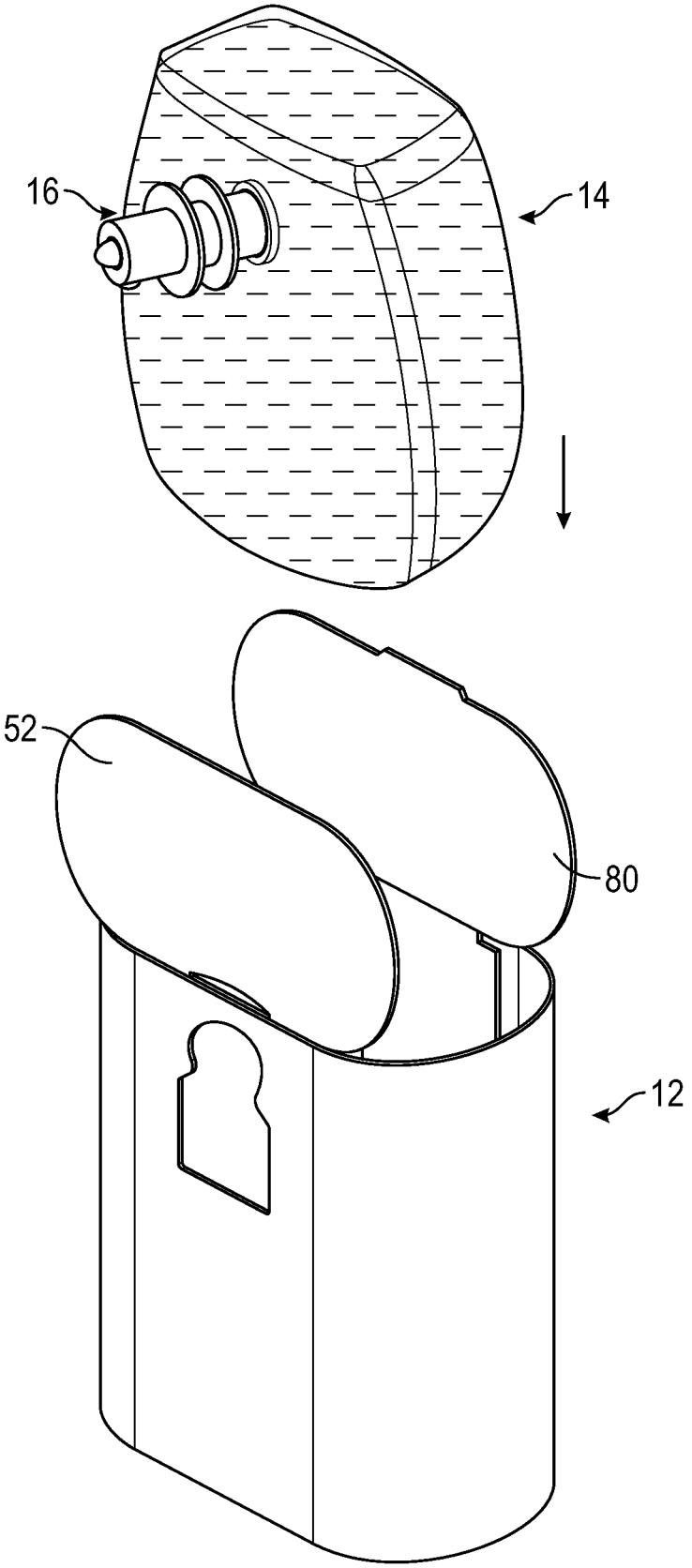
Figure 9:
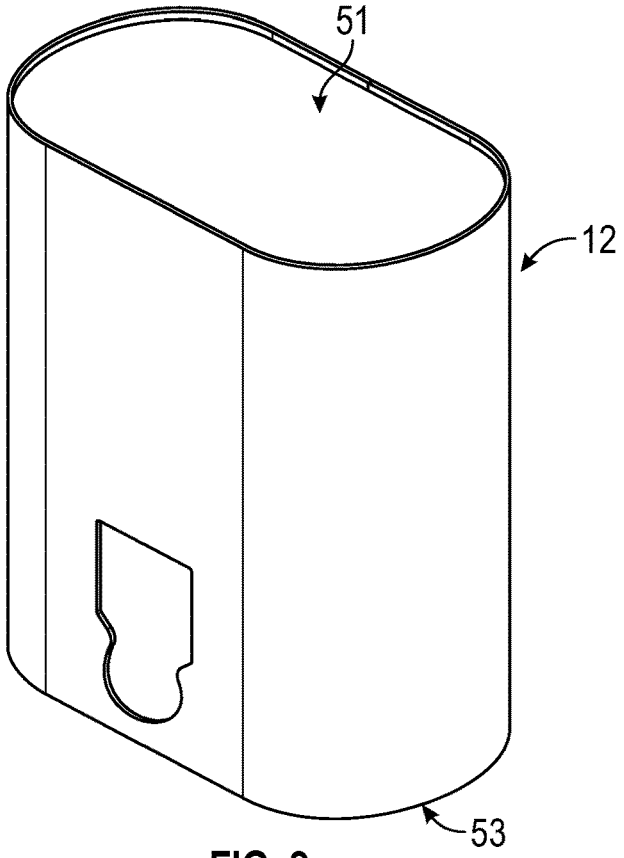
FIG. 9 is a perspective view of the bag-in-box packaging of FIG. 1, showing the bag-in-box packaging in an unopened configuration.

Referring to FIG. 8, filled inner bag 14 may be inserted into the interior of the outer box 12 through its open bottom end. Inner bag 14 is oriented so that tap 16 will be generally adjacent to tap access feature 60. Second bottom wall panel 80 is folded inwardly about fold line 82 until it is substantially perpendicular to rear panel 74. Tab 84 of rear-side insert blank 22 is received within aperture 58, thereby arresting further downward folding of second bottom flap 80. Glue or other adhesive treatment is applied to the outer surface of second bottom flap 80 or, alternatively, to the inner surface of first bottom flap 52. First bottom flap 52 is then folded inwardly about fold line 54, thereby brining its inner surface into face-contacting relationship with the outer surface of second bottom flap 80 and securing it thereto. First and second bottom flaps 52, 80 together form composite bottom wall 53 of the outer box 12. This completes formation of bag-in-box packaging 10 as shown in FIG. 9.

The bag-in-box packaging can be used in its upright configuration (as shown in FIG. 1) without requiring the use of a pressure-assisted dispensing advice. A user uses a finger or tool to puncture the outer box 12 along tear lines 62, 66, 64. Lower tab 72 may be completely removed from outer box 12 and discarded. Upper tab 70 may be folded back out of the way along fold line 68, allowing a user to reach into the interior of the box through the opening created by removal of lower tab 72 and the displacement of upper tab 70. The user grasps tab 16 and directs it out of the box through the opening. The tap can then be coupled to the box by positioning the tap within the circular portion of the opening so that an adjacent edge of outer box 12 is received within the slot defined between flanges 28 and 30. Optionally, upper tab 70 may be folded back into place so that its lower free edge is received within an upper portion of the slot defined between flanges 28 and 30. The tap 16 can then be actuated via actuator 36 to dispense product.

Figure 10:
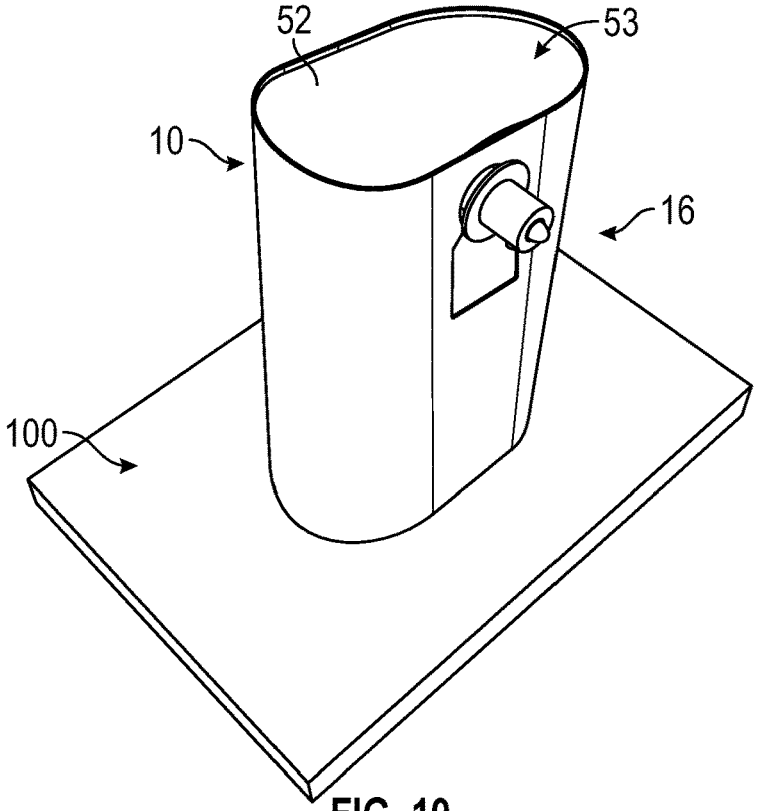
FIG. 10 is a perspective view of the bag-in-box packaging of FIG. 1 coupled to a pressure-assisted dispensing device.
Figure 11:
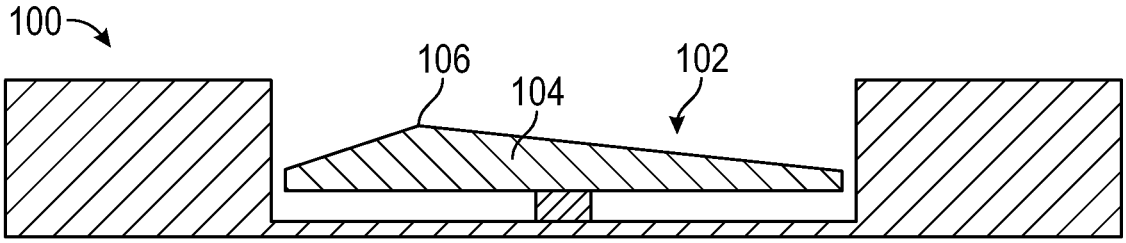
FIG. 11 is a cross-sectional side view of the pressure-assisted dispensing device of FIG. 10.
Figure 12:
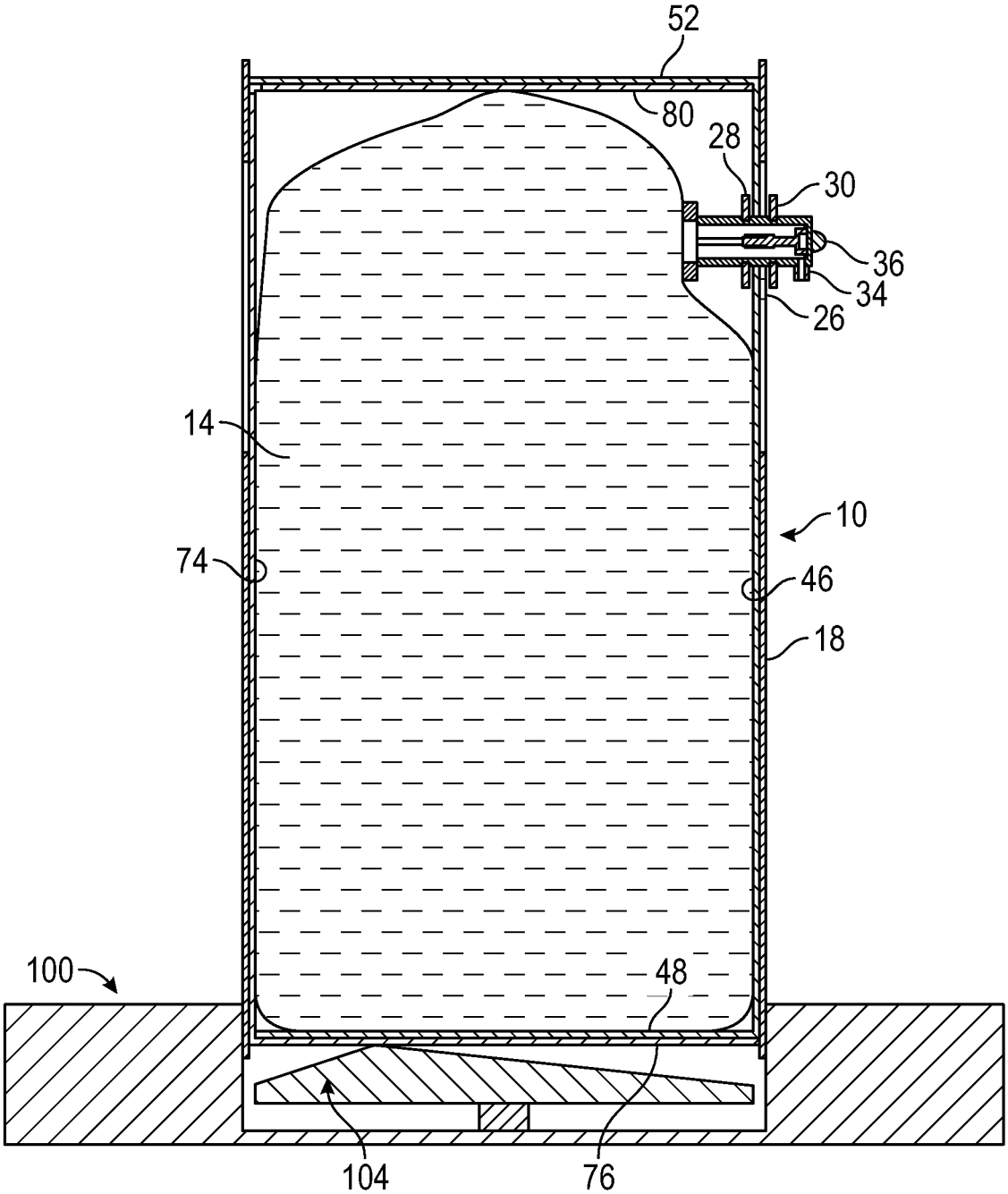
FIG. 12 is a cross-sectional side view of the pressure-assisted dispensing device and bag-in-box packaging of FIG. 10 in an initial configuration.

The bag-in-box packaging 10 is also suitable for use in an inverted configuration when used with a pressure-assisted dispensing device 100. Pressure-assisted dispensing device 100 includes an aperture 102 configured to receive the top end of the bag-in-box packaging 10. A piston plate 104 is reciprocally disposed within the interior of aperture 102. Piston plate 104 preferably has an asymmetric triangular cross-sectional shape as shown in FIG. 10. Piston plate 104 thus defines an off-center, upwardly-projecting ridge or crest 106. The bag-in-box packaging 10 can be inserted top-down into the aperture 102, bringing top wall 51 into contact with piston plate 104. Crest 106 is configured to be aligned with fold line 90 of second top flap 76. Thus, crest 106 is brought into contact with the portion of the outer surface of second top flap 76 that is opposite fold line 90. A top closure element (not shown) of pressure-assisted dispensing device may be used to hold outer box 12 in place within aperture 102. The user presses down firmly on the bag-in-box packaging 10, causing the top wall 51 to be severed from side wall 55 along tear lines 50, 78 and driven upwards into the interior of the outer box 12. Fold line 90 and the angled nature of piston plate 104 facilitate a controlled creasing of second top flap 76 along fold line 90, thereby facilitating the sliding of top wall 51 within the interior of the outer box 12.

Figure 13:
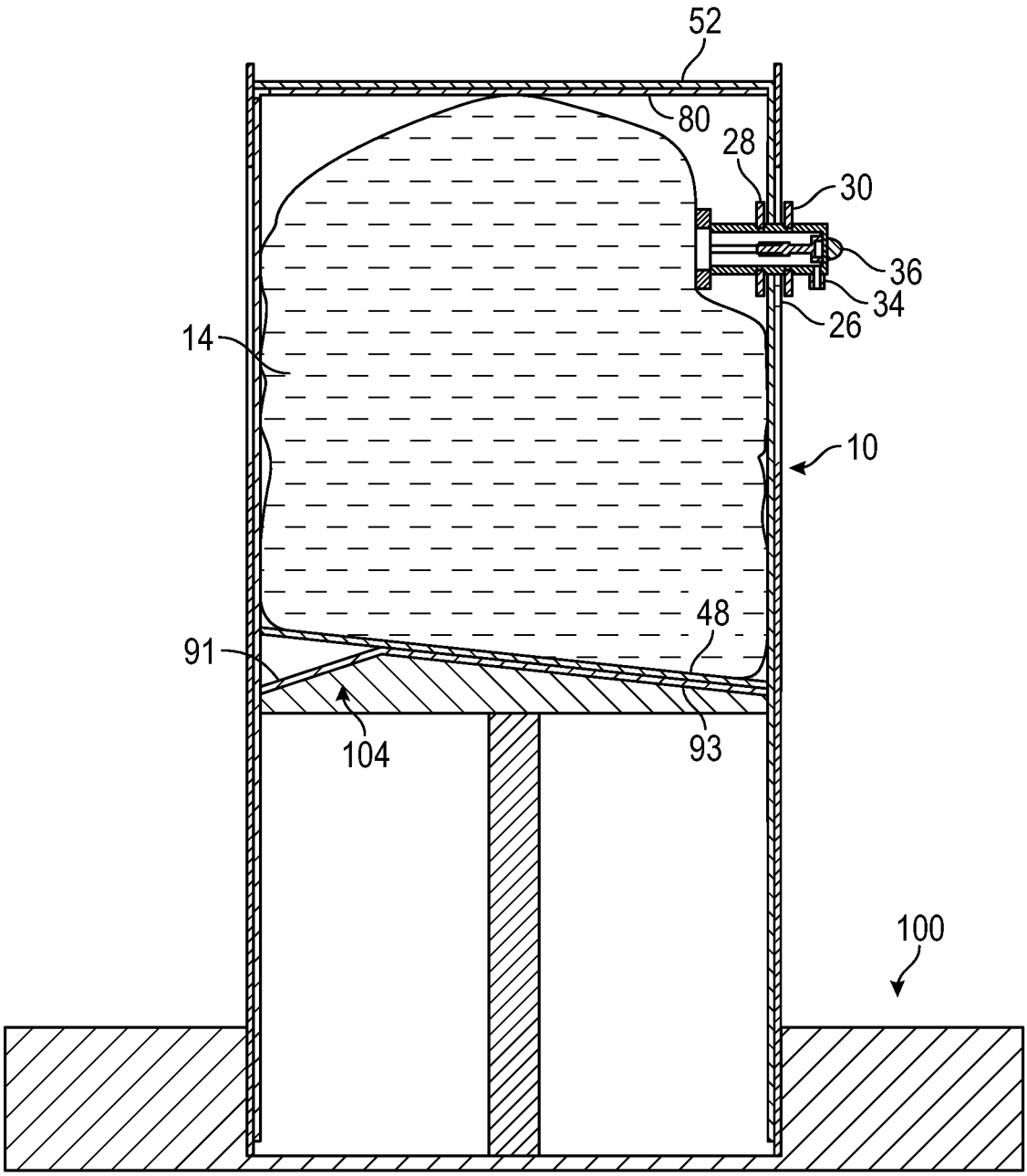
FIG. 13 is a cross-sectional side view of the pressure-assisted dispensing device and bag-in-box packaging of FIG. 10 in a second configuration, following the dispensing of some of the inner bag's contents.

Pressure-assisted dispensing device 100 is configured to drive piston plate 104 upwards so as to maintain a relatively constant amount of pressure on bag 14, thereby enabling the bag's contents to be dispensed from tap 16 upon its actuation. Thus, as the bag's contents are emptied by dispensing, piston plate 104 extends further upwards into the interior of the outer box 12 (as shown in FIG. 13). The configuration of piston plate 104 and the controlled creasing of second top flap 76 along fold line 90 (as well as the absence of an adhesive connection between inner portion 91 and first top flap 48) facilitates an angling of the top wall's inner surface that advantageously tends to direct fluid towards the dispensing side of the bag-in-box packaging 10, and thus towards tap 16, as the bag 14 is emptied.

The use of a dispensing tap with a rotatable dispensing portion 32 may be particularly desirable to facilitate the use of the bag-in-box packaging 10 in either an upright or inverted configuration. When using the bag-in-box packaging 10 in its inverted configuration, it may be particularly desirable to make use of upper tab 70 to lock tap 16 in place. In addition, or in the alternative, pressure-assisted dispensing device may include a feature configured to hold the tap 16 in place during use.

Exemplary embodiments of blanks, packaging and methods of forming and using the same are described above in detail. The apparatus and methods are not limited to the specific embodiments described herein, but rather, components of apparatus and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A bag-in-box packaging comprising:

an outer box;

a collapsible inner bag disposed within an interior of said outer box;

a dispensing tap coupled to said inner bag;

wherein the outer box comprises a side wall, a tap access feature formed in said side wall, and a removable top wall, wherein said top wall comprises overlapping first and second top flaps, wherein said first top flap is hingedly connected to a front side of said side wall along a first tear line, wherein said second top flap is hingedly connected to a rear side of said side wall along a second tear line, wherein said rear side of said side wall is disposed opposite said front side, wherein said top wall is separable from said side wall along said first and second tear lines;

wherein said side wall comprises a front panel, a rear panel disposed opposite said front panel, and a side wall blank wrapped around said front and rear panels, wherein said first top flap is hingedly connected to said front panel along said first tear line, wherein said second top flap is hingedly connected to said rear panel along said second tear line.

2. The bag-in-box packaging of claim 1, wherein said front and rear panels are generally rectangular in shape.

3. The bag-in-box packaging of claim 1, wherein said outer box is generally cylindrical in shape.

4. The bag-in-box packaging of claim 1, wherein said side wall blank comprises a tap access aperture disposed over said tap access feature.

5. The bag-in-box packaging of claim 1, wherein said side wall blank comprises a single faced corrugated material.

6. A bag-in-box packaging comprising:

an outer box;

a collapsible inner bag disposed within an interior of said outer box;

a dispensing tap coupled to said inner bag;

wherein the outer box comprises a side wall, a tap access feature formed in said side wall, and a removable top wall, wherein said top wall comprises overlapping first and second top flaps, wherein said first top flap is hingedly connected to a front side of said side wall along a first tear line, wherein said second top flap is hingedly connected to a rear side of said side wall along a second tear line, wherein said rear side of said side wall is disposed opposite said front side, wherein said top wall is separable from said side wall along said first and second tear lines;

wherein said second top flap comprises a fold line extending between opposite side edges of said second top flap and dividing said top flap into an inner portion and an outer portion, wherein said outer portion is larger in area than said inner portion.

7. The bag-in-box packaging of claim 6, wherein said fold line comprises one or more partial-depth cuts formed on an interior surface of said second top flap.

8. The bag-in-box packaging of claim 6, wherein an interior surface of said outer portion is adhesively connected to said first top flap, and wherein said inner portion is not adhesively connected to said first top flap.

9. The bag-in-box packaging of claim 1, wherein said outer box comprises a bottom wall, wherein said bottom wall comprises overlapping first and second bottom flaps, wherein said first bottom flap is hingedly connected to said front side of said side wall, wherein said second bottom flap is hingedly connected to said rear side of said side wall.

10. The bag-in-box packaging of claim 1, wherein said tap access feature comprises at least one removable tab.

11. The bag-in-box packaging of claim 1, wherein said bag-in-box packaging is configured for use with a pressure-assisted dispensing device.

* * * * *